US008306801B2

(12) United States Patent
Nunez et al.

(10) Patent No.: US 8,306,801 B2
(45) Date of Patent: Nov. 6, 2012

(54) VIRTUAL RESERVOIR SENSOR

(75) Inventors: Gustavo Nunez, Baden (AT); Georg Zangl, Laxenburg (AT); Michael Stundner, Baden (AT)

(73) Assignee: Schlumberger Technology Corporation, Sugar Land, TX (US)

( * ) Notice: Subject to any disclaimer, the term of this patent is extended or adjusted under 35 U.S.C. 154(b) by 261 days.

(21) Appl. No.: 12/707,681

(22) Filed: Feb. 18, 2010

(65) Prior Publication Data

US 2011/0040543 A1 Feb. 17, 2011

Related U.S. Application Data

(60) Provisional application No. 61/233,185, filed on Aug. 12, 2009.

(51) Int. Cl.
*G06G 7/58* (2006.01)

(52) U.S. Cl. ..... 703/10

(58) Field of Classification Search ..... 703/9, 10
See application file for complete search history.

(56) References Cited

U.S. PATENT DOCUMENTS

| | | | | |
|---|---|---|---|---|
| 4,969,130 | A * | 11/1990 | Wason et al. | 367/73 |
| 7,739,089 | B2 * | 6/2010 | Gurpinar et al. | 703/10 |
| 2005/0073910 | A1 | 4/2005 | Cole et al. | |
| 2008/0162100 | A1 | 7/2008 | Landa | |
| 2008/0288226 | A1 * | 11/2008 | Gurpinar et al. | 703/10 |
| 2009/0164187 | A1 | 6/2009 | Habashy et al. | |

* cited by examiner

*Primary Examiner* — David Silver
(74) *Attorney, Agent, or Firm* — Colin Wier

(57) ABSTRACT

One or more computer-readable media include computer-executable instructions to instruct a computing system to receive simulation results for future behavior of a reservoir that includes a material production well and a fluid injection site; define a virtual sensor as being located between the material production well and the fluid injection site; determine fluid saturation at the virtual sensor based at least in part on the simulation results; and issue a notification if the fluid saturation at the virtual sensor exceeds a fluid saturation limit. Various other apparatuses, systems, methods, etc., are also disclosed.

19 Claims, 10 Drawing Sheets

Some Parameters 420

| Virtual Sensors | Water Saturation ($S_W$) | Pressure ($P_S$) | Other |
|---|---|---|---|
| X = 700 m | SW_N_RX | PS_N_RX | O_N_RX |
| Y = 300 m | SW_S_RX | PS_S_RX | O_S_RX |
| ΔXY = 400 m | SW_E_RX | PS_E_RX | O_E_RX |
| | SW_W_RX | PS_W_RX | O_W_RX |
| Sensor Block: | SW_N_RY | PS_N_RY | O_N_RY |
| Nodes | SW_S_RY | PS_S_RY | O_S_RY |
| Formulas | SW_E_RY | PS_E_RY | O_E_RY |
| Alarms | SW_W_RY | PS_W_RY | O_W_RY |

VIRTUAL RESERVOIR SENSOR

RELATED APPLICATIONS

This application claims the benefit of a related U.S. Provisional Application Ser. No. 61/233,185, filed Aug. 12, 2009, entitled "Virtual Reservoir Sensor", to Nunez et al., the disclosure of which is incorporated by reference herein in its entirety.

BACKGROUND

Techniques to aid recovery of material from a reservoir include so-called history matching where simulation results from a mathematical model of the reservoir are matched with real data about the reservoir. Once matched, the mathematical model can be used to address issues that may arise during recovery of material from the reservoir. For example, a typical issue arises when fluid injected into a reservoir, to aid recovery of material, arrives at a material extraction well. In this example, given a historically matched mathematical model, newly acquired data germane to the issue can be input and a subsequent simulation run. The results of this subsequent simulation can then be analyzed to formulate a plan to address the issue. The foregoing process can be viewed as reactive because the formulated plan occurs only in response to actual occurrence of the issue. Various techniques described herein can allow for proactive reservoir management.

SUMMARY

One or more computer-readable media include computer-executable instructions to instruct a computing system to receive simulation results for future behavior of a reservoir that includes a material production well and a fluid injection site; define a virtual sensor as being located between the material production well and the fluid injection site; determine fluid saturation at the virtual sensor based at least in part on the simulation results; and issue a notification if the fluid saturation at the virtual sensor exceeds a fluid saturation limit. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
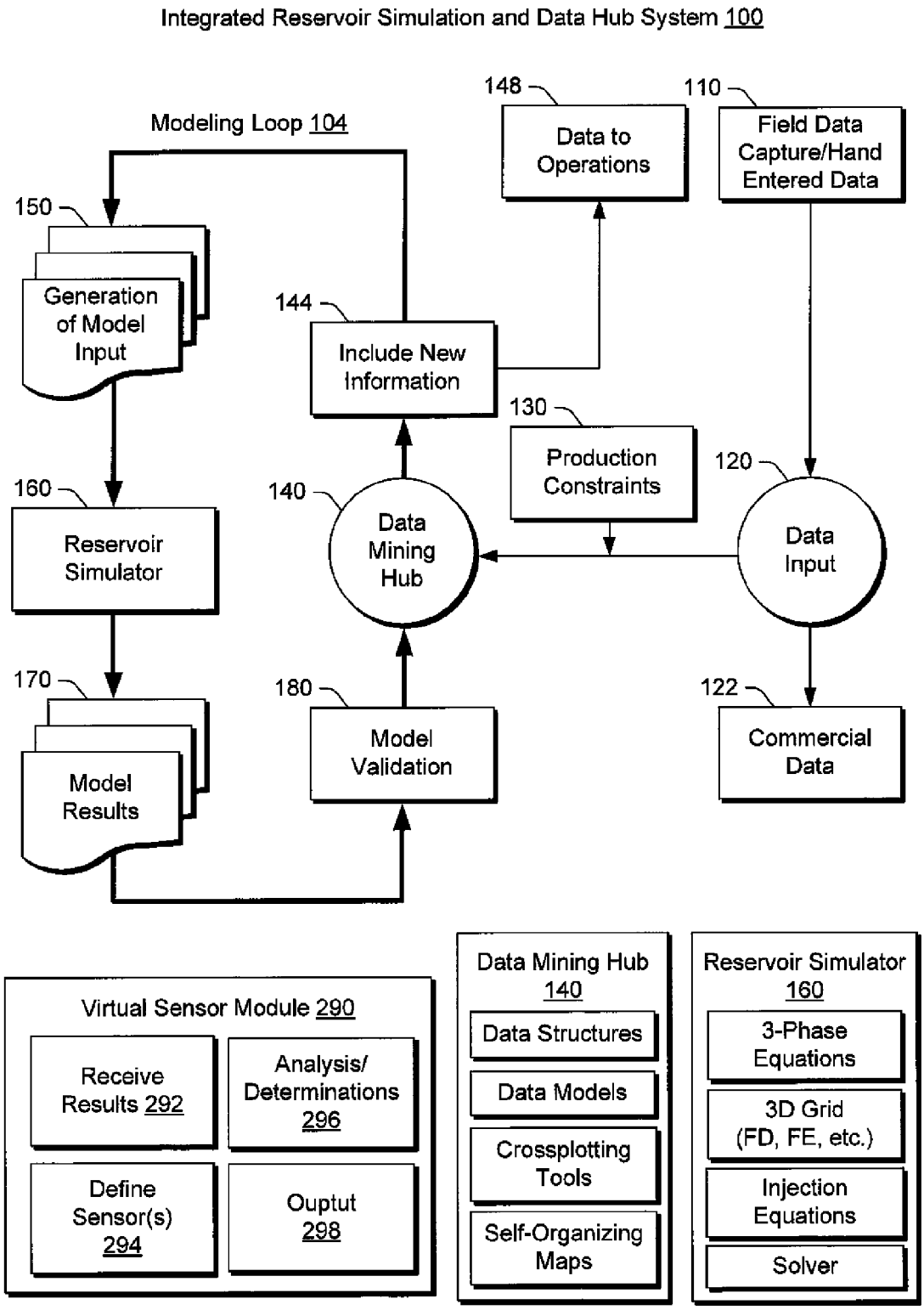
FIG. 1 illustrates an example modeling system that includes a reservoir simulator, a data mining hub and a virtual sensor module.

FIG. 1 shows an integrated reservoir simulation and data hub system 100. The system 100 includes a modeling loop 104 composed of various modules configured to receive and generate information. In a typical operational process, the system 100 receives, at a field data block 110, field data about a reservoir, which may be captured electronically via one or more data acquisition techniques, gathered "by hand" through observation or reporting, etc. The field data block 110 transmits the received data to a data input 120 configured to input data to the modeling loop 104. The data input 120 may also provide some of the received field data to a commercial data block 122 (e.g., for any of a variety of commercial purposes such as financial modeling).

The system 100 includes a production constraints block 130, which may provide information, for example, related to production equipment (e.g., pumps, piping, operational energy costs, etc.). The modeling loop 104 receives information via a data mining hub 140. As noted this information can include data from the data input 120 as well as information from the production constraints block 130. The data mining hub 140 may rely at least in part on a commercially available package or set of modules that execute on one or more computing devices. For example, a commercially available package marketed as the DECIDE!® oil and gas workflow automation, data mining and analysis software (Schlumberger Limited, Houston, Tex.) may be used to provide at least some of the functionality of the data mining hub 140.

The DECIDE!® software provides for data mining and data analysis (e.g., statistical techniques, neural networks, etc.). A particular feature of the DECIDE!® software, referred to as Self-Organizing Maps (SOM), can assist in model development, for example, to enhance reservoir simulation efforts. The DECIDE!® software further includes monitoring and surveillance features that, for example, can assist with data conditioning, well performance and underperformance, liquid loading detection, drawdown detection and well downtime detection. Yet further, the DECIDE!® software includes various graphical user interface modules that allow for presentation of results (e.g., graphs and alarms). While a particular commercial software product is mentioned with respect to various data hub features, as discussed herein, a system need not include all such features to implement various techniques. Further, while various features of the data mining hub 140 are shown in FIG. 1 (data structures, cross-plotting tools, data models, and SOMs), such features may be optional.

Referring again to the modeling loop 104 of FIG. 1, the data mining hub 140 acts to include new information per block 144; noting that some or all of such data may be transmitted to a data to operations block 148 (e.g., for use in the field, etc.). The loop 104 relies on the new information of block 144 to generate model input in a generation block 150. For example, the generation block 150 may adjust one or more parameters of a mathematical model of a reservoir based at least in part on the new information. In the system 100, the model input is received by a reservoir simulator 160. The reservoir simulator 160 may rely at least in part on a commercially available package or set of modules that execute on one or more computing devices. For example, a commercially available package marketed as the ECLIPSE® reservoir engineering software (Schlumberger Limited, Houston, Texas) may be used to provide at least some of the functionality of the reservoir simulator 160.

The ECLIPSE® software relies on a finite difference technique, which is a numerical technique that discretizes a physical space into blocks defined by a multidimensional grid. Numerical techniques (e.g., finite difference, finite element, etc.) typically use transforms or mappings to map a physical space to a computational or model space, for example, to facilitate computing. Numerical techniques may include equations for heat transfer, mass transfer, phase change, etc. Some techniques rely on overlaid or staggered grids or blocks to describe variables, which may be interrelated. As shown in FIG. 1, the reservoir simulator 160 includes equations to describe 3-phase behavior (e.g., liquid, gas, gas in solution), injection equations to model injection techniques, a 3D grid feature to discretize a physical space and a solver to solve reservoir models.

As shown in FIG. 1, the reservoir simulator 160 provides results 170 based on a reservoir model. Per a validation block 180, the results 170 may be validated, for example, by comparison to acquired physical data for the reservoir. The loop 104 may continue iteratively as new data is introduced via the data mining hub 140.

Figure 2:
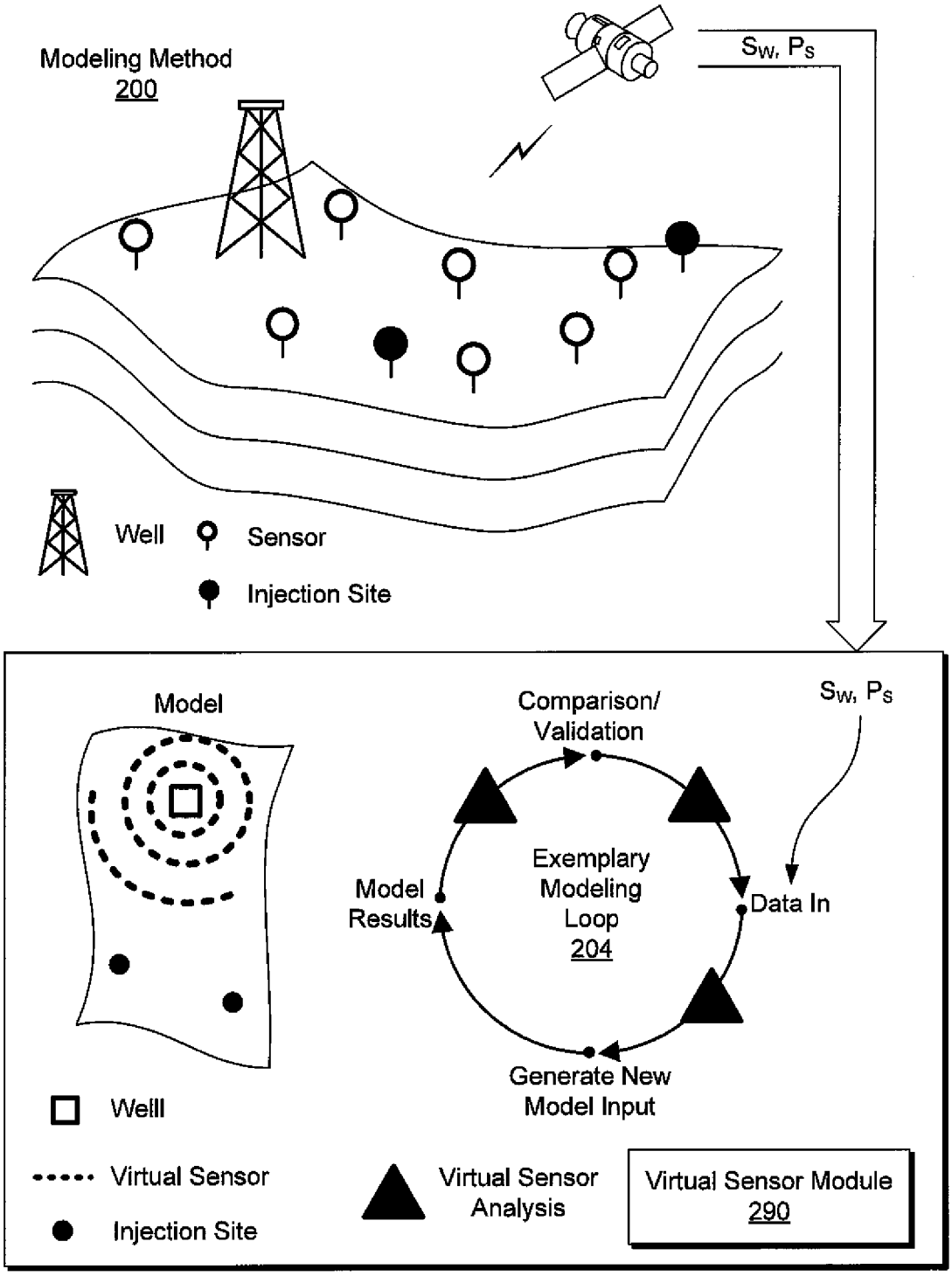
FIG. 2 illustrates an example scheme that includes a modeling loop associated with one or more virtual sensors.

FIG. 1 also shows a virtual sensor module 290, which may be configured to operate in coordination with the data mining hub 140, the reservoir simulator 160 or both, for example, as described in FIG. 2. As shown in FIG. 1, the module 290 includes a reception block 292 to receive results, a definition block 294 to define one or more virtual sensors, an analysis or determination block 296 to perform analyses or make determinations and an output block 298 for outputting information based at least in part on a defined virtual sensor.

As described herein, one or more computer-readable media can include computer-executable instructions to instruct a computing system to receive simulation results for future behavior of a reservoir that includes a material production well and a fluid injection site; define a virtual sensor as being located between the material production well and the fluid injection site; determine fluid saturation at the virtual sensor based at least in part on the simulation results; and issue a notification as output if the fluid saturation at the virtual sensor exceeds a fluid saturation limit. One or more media may include instructions to determine pressure at the virtual sensor based at least in part on the simulation results and to issue a notification if the pressure at the virtual sensor exceeds a pressure limit.

In various examples, future behavior corresponds to a future time. A module may include instructions to issue a notification prior to the future time. Further, a module may include instructions to determine an adjustment to one or more parameters associated with recovery of material from a reservoir by a material production well and optionally call for such adjustments at a particular time (e.g., prior to the future time).

As described herein, fluid may be liquid, gas or a combination of liquid and gas. For example, fluid saturation may be gas saturation or liquid saturation. Fluid saturation may include both gas saturation and liquid saturation. Accordingly, a module may include instructions to determine gas saturation and liquid saturation at a virtual sensor (e.g., based at least in part on simulation results).

FIG. 2 shows a modeling method 200 for modeling a reservoir that includes a well and optionally one or more sensors, injection sites or other equipment associated with material recovery from the reservoir. In the example of FIG. 2, various sensors communicate information (e.g., wired or wirelessly) such as saturation, flow, and pressure information. Well equipment and injection equipment may also be equipped to sense information and communicate sensed information. As indicated, sensed information is communicated to a modeling loop 204 that relies on virtual sensor analysis using the virtual sensor module 290.

As described herein, a model can include one or more virtual sensors. In the example of FIG. 2, a virtual sensor is defined with respect to a model of the reservoir (see, e.g., dashed lines that represent virtual sensor rings and a virtual sensor arc). The modeling loop 204 includes one or more virtual sensor analyses, for example, performed using the virtual sensor module 290. A virtual sensor analysis may provide information (e.g., historic, present or future) germane to material recovery. For example, the virtual sensor module 290 may be configured to analyze one or more model variables over a boundary line, a surface or a volume defined by a virtual sensor. The modeling loop 204 shows virtual sensor analyses as optionally occurring after a simulation (e.g., block 160), a validation (e.g., block 180), or date input (e.g., block 140). As described herein, the virtual sensor module 290 may be configured as add-on software for receiving input from one or more modules of the system 100 and for providing output to one or more modules of the system 100. Alternatively, the virtual sensor module may be integrated into one or more modules of the system 100.

As described herein, a method may include providing a reservoir model history matched (or other reservoir model), providing regions where a user would like to install one or more virtual sensors (model blocks/distance from the wells), providing triggers for running workflow (e.g., 24/7), providing a graphical user interface (GUI or "desktop") for rules and workflows design and implementation, a communication interface (e.g., between a simulator and data hub) to: elaborate a restart file with the new back allocation data; run a simulator for one time step; read simulation results from different simulator keywords; and estimate well rate and production (e.g., using commercially available software such as the PIPESIM® software marketed by Schlumberger Limited).

Figure 3:
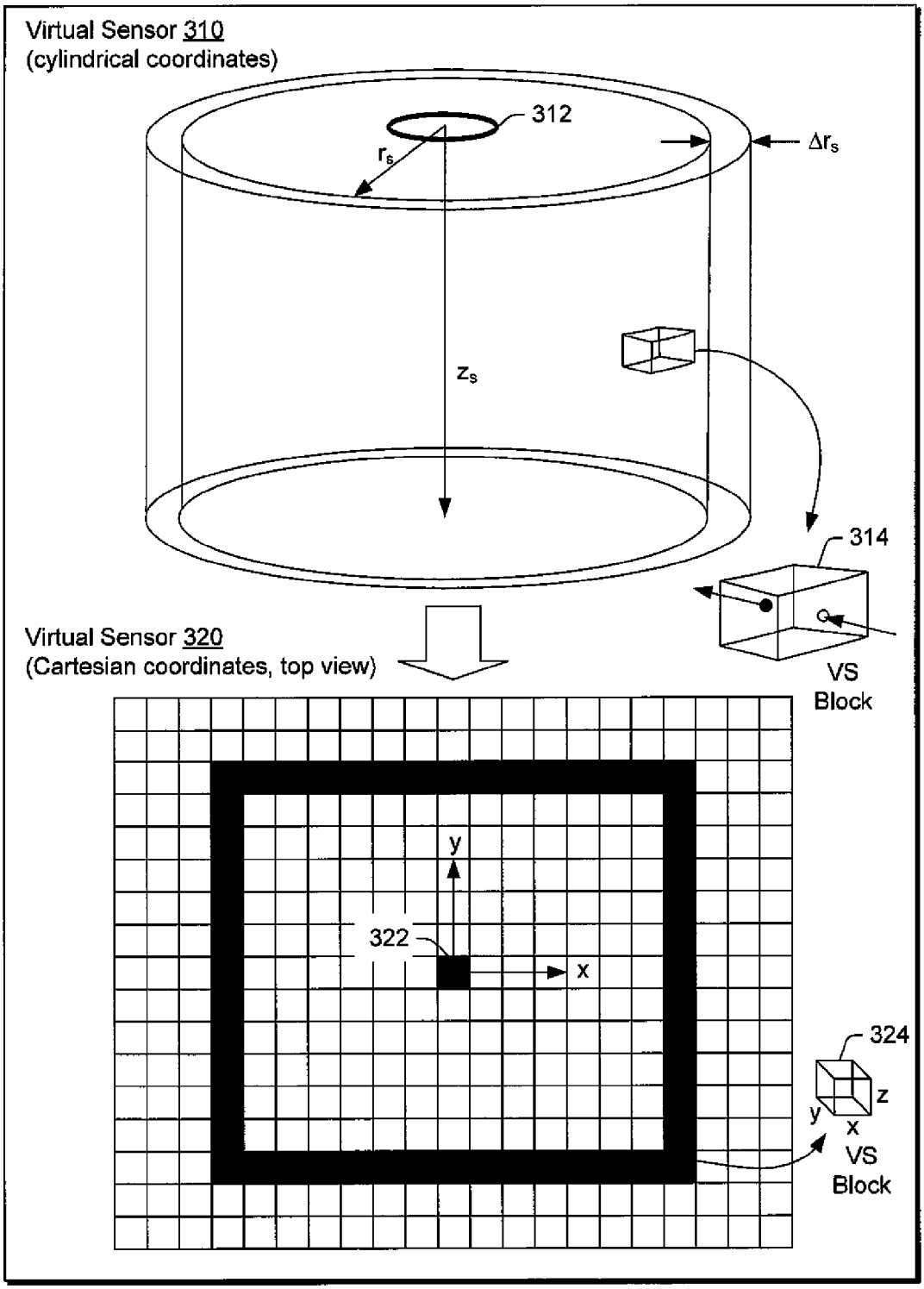
FIG. 3 illustrates an example virtual sensor in a cylindrical coordinate system and in a Cartesian coordinate system.

FIG. 3 shows a virtual sensor 310 as an annular cylinder in a cylindrical coordinate system having a radial dimension ($r_s$), an annular dimension ($\Delta r_s$) and an axial dimension ($z_s$) centered with respect to a well 312 along with a virtual sensor block 314 (shown with respect to surface vectors). FIG. 3 also shows a virtual sensor 320 as a walled block in a Cartesian coordinate system having x, y and z dimensions centered with respect to a well 322 along with a virtual sensor block 324. A virtual sensor may extend to a defined depth as well as be located at a depth (e.g., consider a ring shaped virtual sensor that does not extend to a defined ground surface). While circular and rectangular cross-sections are shown, a virtual sensor may have a different shape (e.g., other polygon, ellipse, oval, etc.). While a virtual sensor generally has a 3D structure, wall thickness of a virtual sensor may range from essentially zero to a defined thickness (e.g., that may have an associated physical significance). In FIG. 3, the virtual sensor 320 is shown with respect to a grid, which may be, for example, associated with a numerical technique for reservoir simulation or a post-simulation processing technique for the virtual sensor 320.

Figure 4:
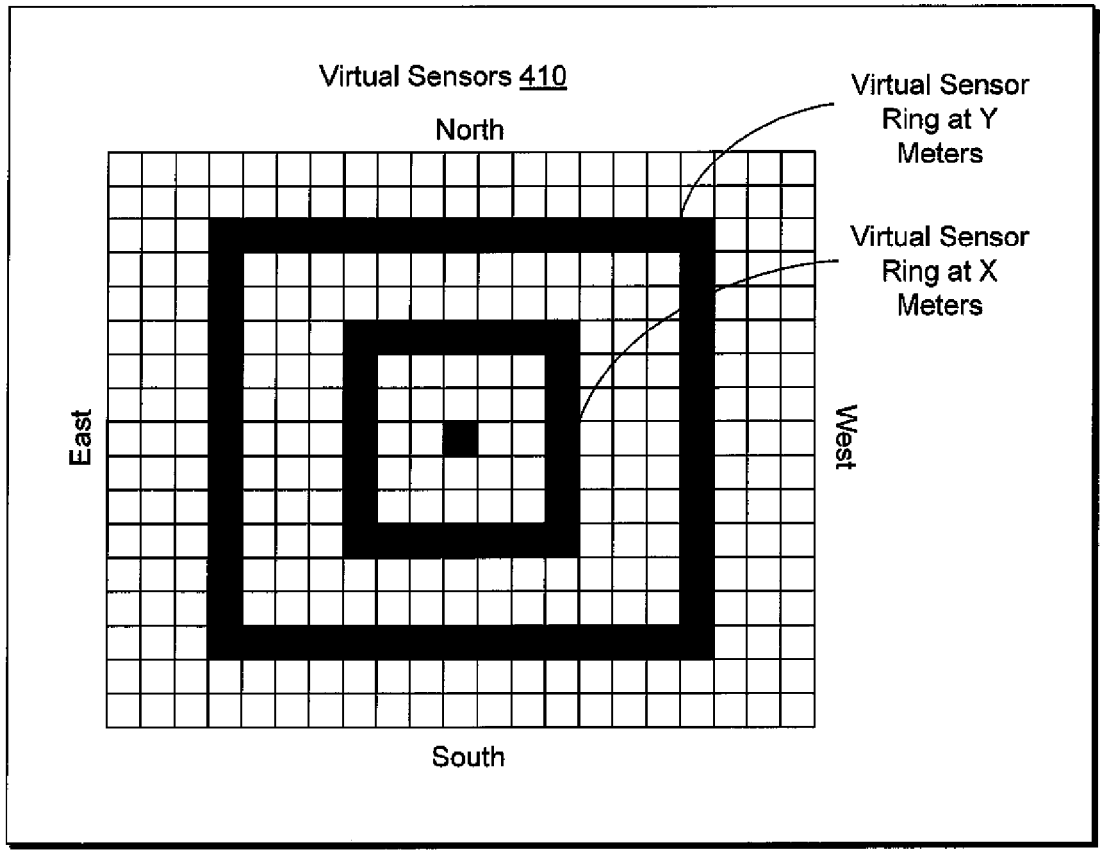
FIG. 4 illustrates example virtual sensors in a model space and a listing of some parameters that may be associated with one or more virtual sensors.

FIG. 4 shows concentric sensors 410 as including a virtual sensor at about X meters (or blocks) from a well and a virtual sensor at about Y meters (or blocks) from the well and some parameters 420. Water saturation, pressure and other parameters are defined with respect to north, south, east and west facing boundaries of the virtual sensors.

Figure 5:
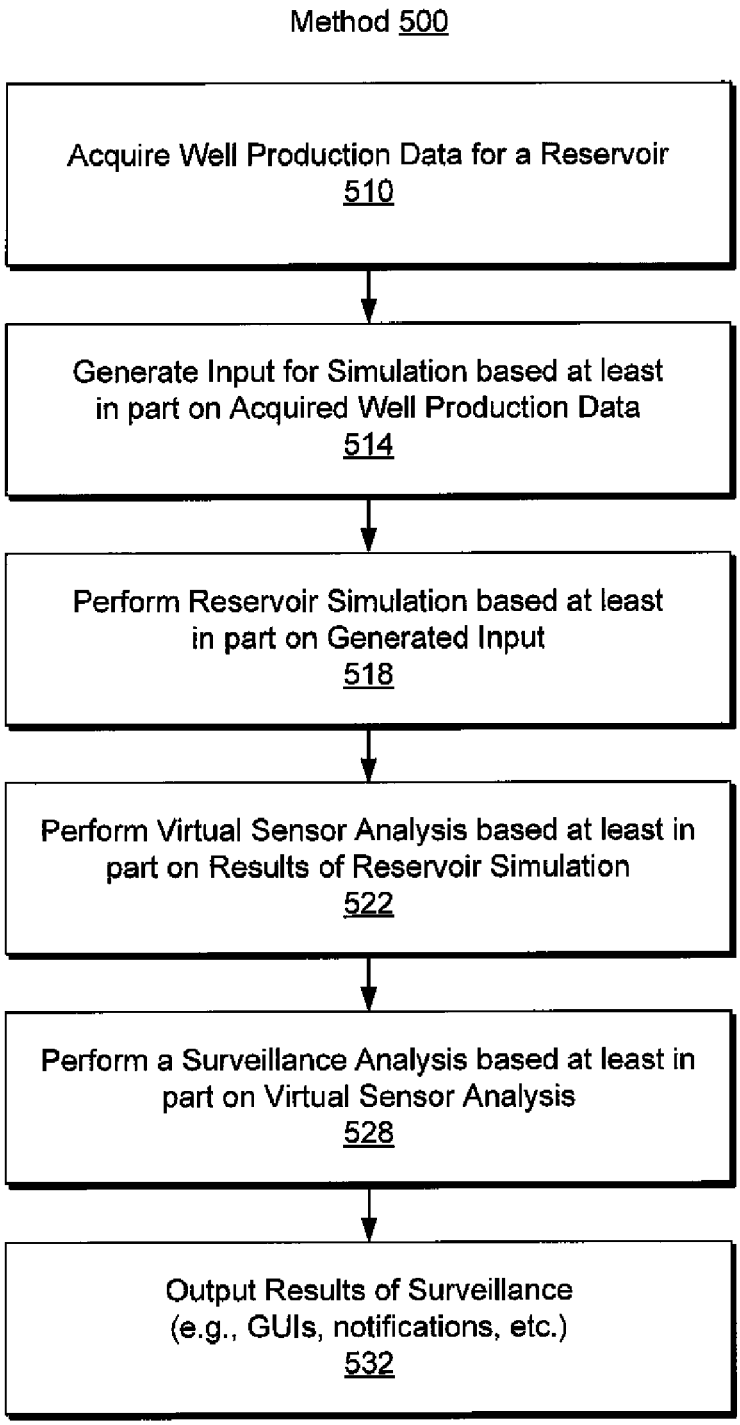
FIG. 5 illustrates an example method for outputting results based at least in part on one or more virtual sensors.

FIG. 5 shows a method 500 that includes a virtual sensor analysis. The method 500 may be implemented using various features of the system 100 of FIG. 1 as well as various virtual sensor features shown in FIGS. 2, 3 and 4. As described herein, the method 500 may be performed, at least in part, according to the modeling loop 204 of FIG. 2.

As shown in the example of FIG. 5, in an acquisition block 510, well production data for a reservoir is acquired. In a generation block 514, input is generated for a reservoir simulation based at least in part on the acquired well production data. A simulation block 518 performs a reservoir simulation based at least in part on the generated input. A virtual sensor analysis block 522 performs a virtual sensor analysis based at least in part on results of the reservoir simulation. In the example of FIG. 5, a surveillance analysis block 528 performs an analysis based at least in part on the virtual sensor analysis. An output block 532 outputs results of the surveillance analysis 532 (e.g., via one or more graphical user interfaces, notifications, etc.).

In the method 500, the acquisition block 510 may include reading back allocation production for each well (as new data) using features of the data mining hub 140; the generation block 514 may include preparing a restating file for the simulator 160 with the new data, triggering the simulator 160 to run a reservoir simulation for one time step (e.g., a current condition mode) and triggering the simulator 160 to run reservoir simulations for multiple time steps (e.g., multiple one year time steps per a forecast mode); the performance block 518 may include using the simulator 160 to run simulations (e.g., as triggered); the performance block 522 may include, after running one or more desired current mode and forecast mode simulations, calculating values associated with one or more virtual sensors (e.g., calculating average water saturation ($S_w$), gas saturation ($S_g$) for each wall of a virtual sensor and calculating the average reservoir pressure for each sensor) using the virtual sensor module 290; the performance block 528 may include performing a surveillance workflow that relies on the calculated values (e.g., as part of a surveillance workflow of the block 140). The output block 532 may include triggering a notification if one or more of the values are higher than a predefined limit or limits (e.g., as part of a notification process of the block 140).

Given virtual sensor information, a method may include calculating at least some additional performance indicators (e.g., KPIs) such as: water and gas front speed, identification of direction of a water and gas front, time for a water and gas front to arrive at a defined well bore area and predicted water cut based on B-L. Such a method may be implemented, for example, using one or more features of a data mining hub. Given virtual sensor information, a method may include estimating well rate and aggregated production for a production reconciliation process.

As an example, a method can include a set up process and a workflow process (e.g., how the workflow process would operate on a daily/weekly basis). As an example of a set up process, given a history matched reservoir model:

a) For each well of the reservoir model, two (or three rings) could be defined, for example, a distance from the well could be defined by a user.
b) For each ring, four side walls could be defined for monitoring purposes, for example, each of the walls could be seen as a group of selected model blocks.
c) A selected group of parameters in the reservoir simulator could be defined, such as:
   a. Water Saturation ($S_W$)
   b. Reservoir Pressure ($P_S$)
d) The parameters could be then classified according to their respective locations:
   a. Wat_Sat_North_Ring__2
   b. Wat_Sat_South_Ring__2
   c. Wat_Sat_East_Ring__2
   d. Wat_Sat_West_Ring__2
   e. Wat_Sat_North_Ring__1
   f. Wat_Sat_South_Ring__1
   g. Wat_Sat_East_Ring__1
   h. Wat_Sat_West_Ring__1
e) The distance between rings could also be defined as well as the distance between each ring and the well bore.
f) An example of a keyword suitable for implementation with the ECLIPSE® reservoir simulator could be FIPNUM ("fluid-in-place regions", for example, for reporting on flow from one region of a reservoir to another region of the reservoir). As an example, for each of the regional walls an average result could be output for $S_W$, $S_G$ and $P_s$ after each time step run.

As an example, after a set up process, a workflow process may include:

a) Workflow automation software (e.g., such as the DECIDE!® software) that can read back allocation production for each well. Workflow automation software can also include software that helps in analysis and data mining.
b) Workflow automation software that prepares a restating file for the reservoir simulator with the new data.
c) Workflow automation software that triggers a reservoir simulator model for just one time step (current condition mode).
d) Workflow automation software that triggers a reservoir simulator model for one year time steps (forecast mode).
e) A reservoir simulator that runs the model.
f) A reservoir simulator that calculates an average water saturation ($S_W$) and Gas Saturation ($S_G$) for each of the walls on each rings.
g) A reservoir simulator that calculates the average reservoir pressure ($P_s$) for each of the rings.
h) Workflow automation software that reads these values and runs a surveillance workflow.
i) Workflow automation software that triggers a notification if the values are higher than a predefined limit
j) Workflow automation software that calculates some additional key performance indicators (KPIs) such as:
   a. Water and Gas Front speed;
   b. Identify the direction of the water and gas front;
   c. Time to Water and Gas arrive to well bore area; and
   d. Predicted water cut based on B-L.

k) Workflow automation software and production engineering software that estimate well rate and aggregated production for production reconciliation process.

i) Workflow automation software that is ready to read new data.

Figure 6:
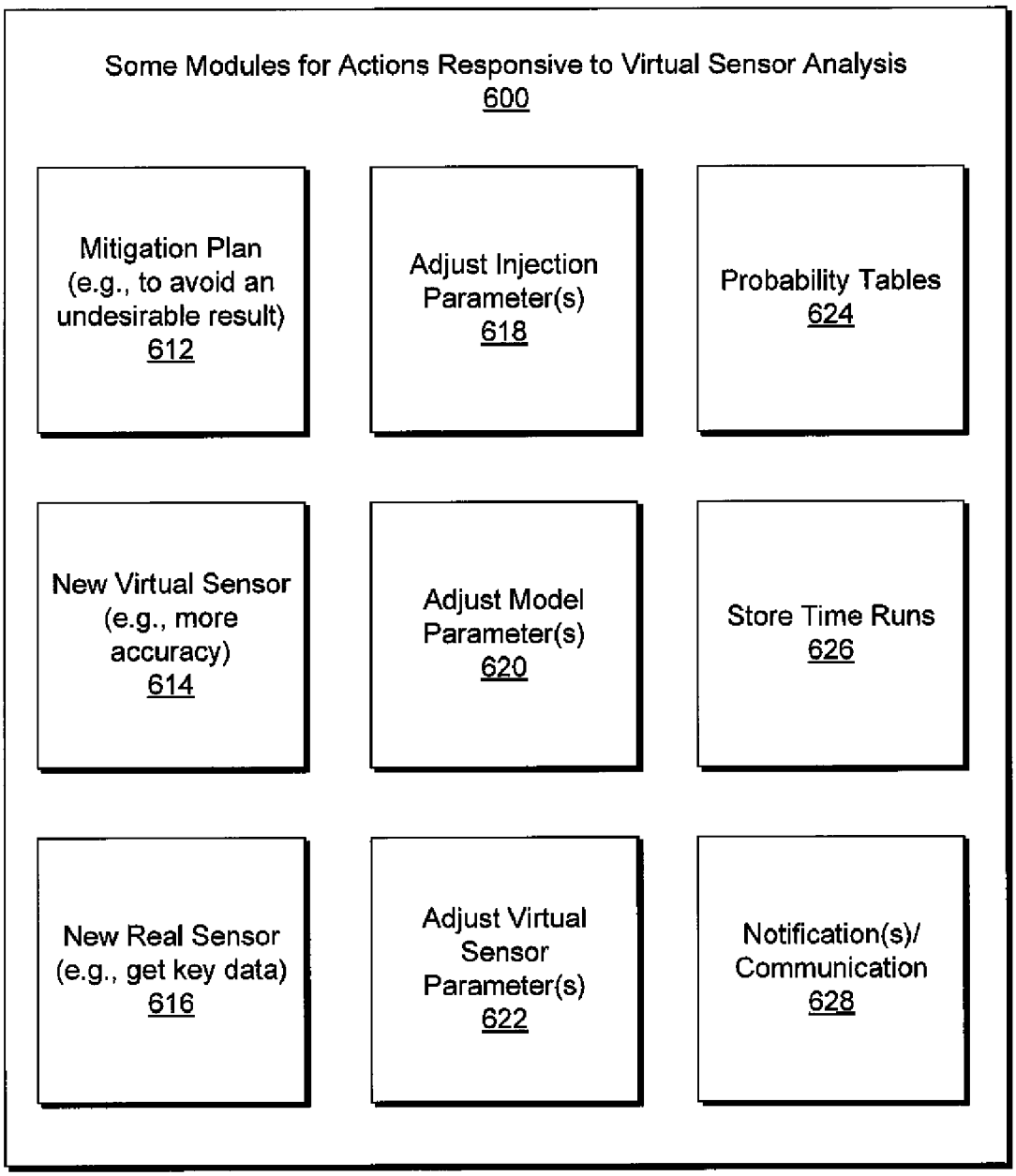
FIG. 6 illustrates example modules for actions based at least in part on a virtual sensor analysis.

FIG. 6 shows various modules for actions based at least in part on a virtual sensor analysis. The modules 600 include a mitigation plan module 612, a new virtual sensor module 614, a new real sensor module 616, an adjustment of injection parameter(s) module 618, an adjustment of model parameter (s) module 620, an adjustment of virtual sensor parameter(s) module 622, a probability tables module 624, a time run storage module 626 and a notification(s) and communications module 628 (e.g., notification criteria and optionally associated communication pathways for notification of recipients via email address, cell phone, etc.). Such modules may be optionally implemented in conjunction with various features of a system that includes one or more virtual sensor modules (e.g., the system 100 as including one or more of the modules 290).

Figure 7:
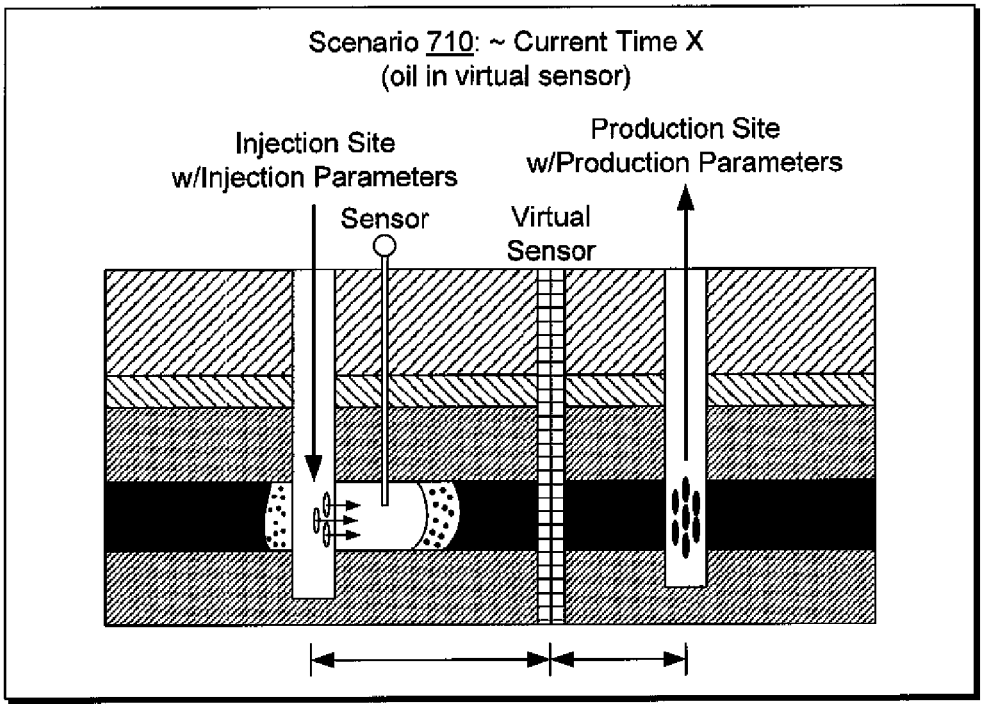
FIG. 7 illustrates an example scenario at a current time and an example scenario at a future time.
Figure 7:
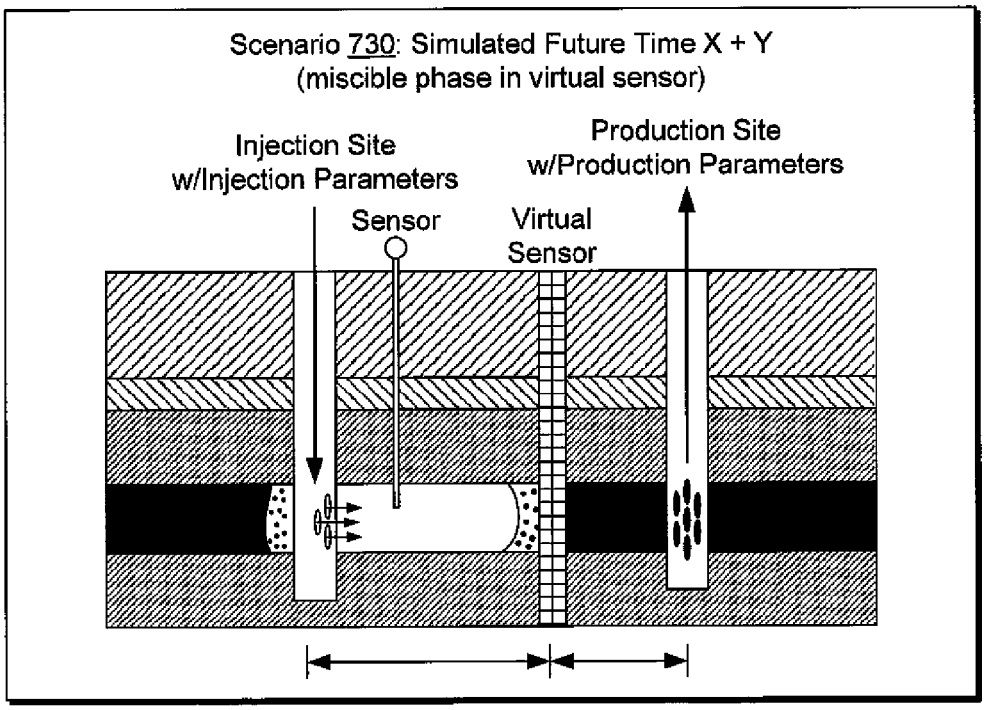

FIG. 7 shows a scenario at a current time 710 (e.g., time X) and a scenario at a future time 730 (e.g., time X+Y). In the current time scenario 710, the front has not reached the virtual sensor. In contrast, in the future time scenario 730, the front has reached the virtual sensor.

Figure 8:
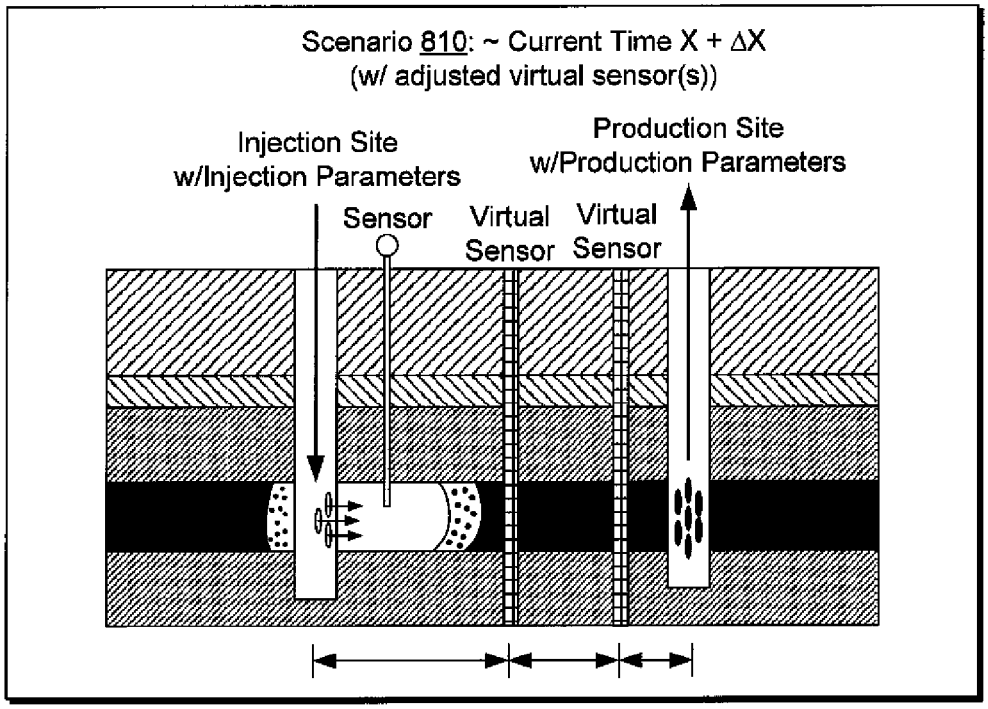
FIG. 8 illustrates an example scenario with one or more adjusted virtual sensors and an example method.
Figure 8:
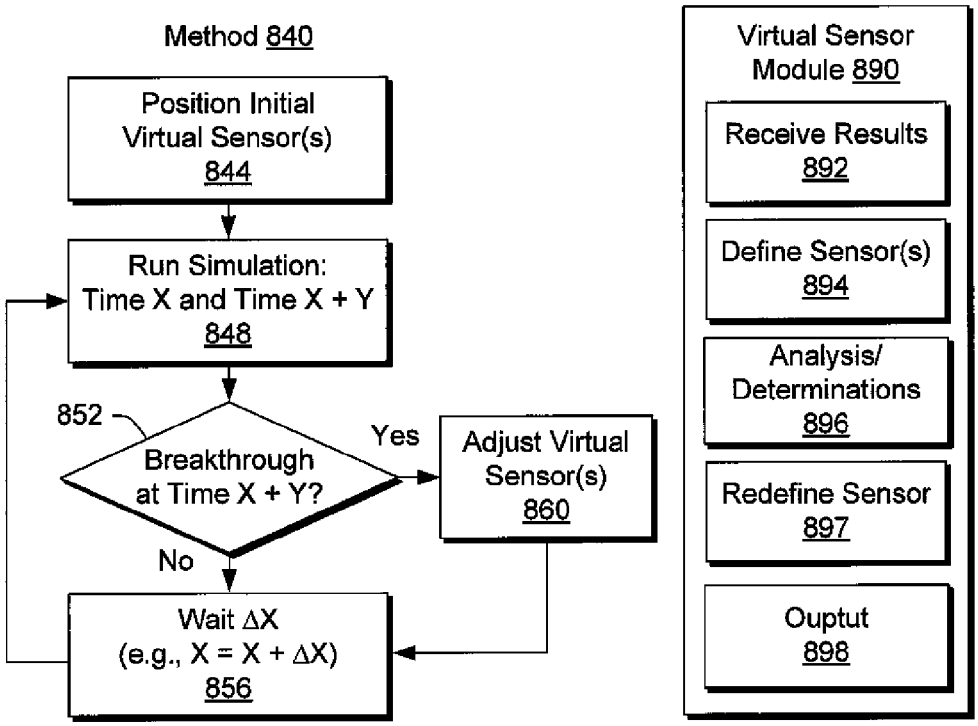

FIG. 8 shows a scenario at the current time (X) plus a small increment (ΔX) 810 along with a method 840 and a virtual sensor module 890. As described herein, virtual sensors may be updated responsive to future time results (e.g., forecast results), for example, according to the method 840.

As shown in FIG. 8, the method 840 includes a position block 844 for initial positioning of one or more virtual sensors. A simulation block 848 runs simulations at a current time and a future time. A decision block 852 decides whether breakthrough has occurred at the future time. If not, the method 840 continues to a wait block 856, which waits for a time until proceeding back to the simulation block 848. However, if the decision block 852 decides that breakthrough has occurred at the future time, the method 800 continues at an adjustment block 860 that adjusts one or more virtual sensors (e.g., as shown in the scenario 810). Such an approach can provide for more robust and timely management of material recovery from a reservoir.

In the example of FIG. 8, the virtual sensor module 890 includes reception instructions 892 to receive simulation results (e.g., for future behavior of a reservoir that includes a material production well and a fluid injection site), definition instructions 894 to define a virtual sensor (e.g., as being located between the material production well and the fluid injection site), determination instructions 896 to determine one or more variables at the virtual sensor based at least in part on the simulation results, redefinition instructions 897 to redefine the virtual sensor or to define an another virtual sensor (e.g., based at least in part on the one or more variables, as being located closer to the material production well or closer to the fluid injection site) and output instructions 898 (e.g., to output one or more notifications or other information).

As described herein, one or more computer-readable media may include computer-executable instructions to instruct a computing system to receive simulation results for future behavior of a reservoir that includes a material production well and a fluid injection site; define a virtual sensor as being located between the material production well and the fluid injection site; determine one or more variables at the virtual sensor based at least in part on the simulation results; and redefine the virtual sensor, based at least in part on the one or more variables, as being located closer to the material production well or closer to the fluid injection site. Such instructions may further provide for defining a second virtual sensor as being located between the material production well and the fluid injection site. With respect to the one or more variables, these may include at least one of fluid front direction, fluid front speed, water saturation, gas saturation and pressure. Further, instructions may provide for determining a time for a fluid front to arrive at a material production well.

As described herein, a method may include, for a reservoir that includes a material production well and a fluid injection site, defining a virtual sensor as being located between the material production well and the fluid injection site; performing a simulation of the reservoir for a future time where an analysis of results from the simulation indicates that fluid reaches the virtual sensor at the future time; and, based at least in part on the results, and prior to the future time, adjusting one or more parameters associated with recovery of material from the reservoir by the material production well.

Figure 9:
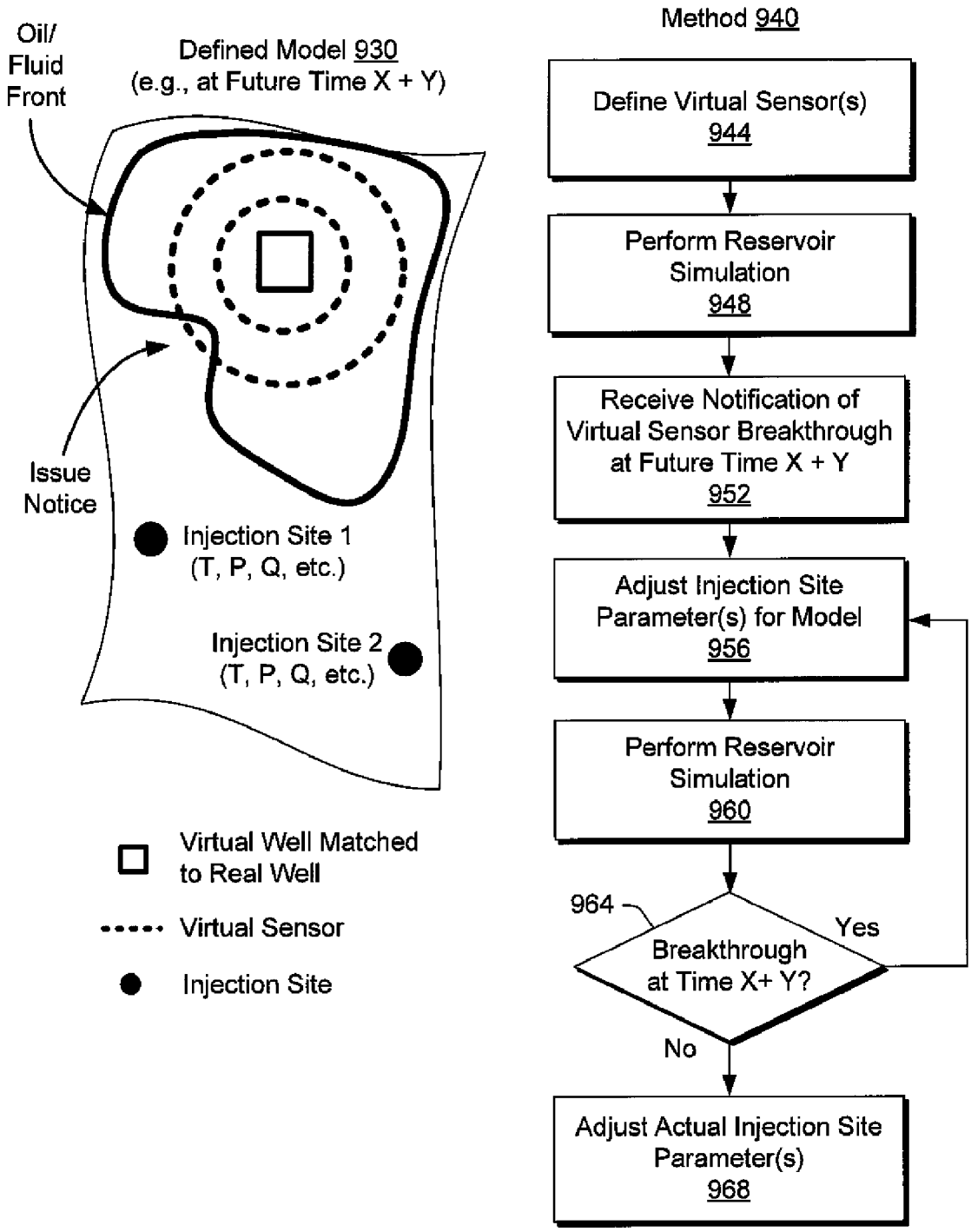
FIG. 9 illustrates an example method and an associated model for optionally adjusting one or more material production parameters based at least in part on a virtual sensor analysis.

FIG. 9 shows a method 940 that relies at least in part on one or more virtual sensors. For example, FIG. 9 shows a diagram of a defined model 930 that includes two virtual sensors (dashed lines) located between a material production well (open box) and two fluid injection sites (solid circles). In the method 940, a definition block 944 includes defining one or more virtual sensors for a model (e.g., such as those of the model 930). In a performance block 948, a reservoir simulation is performed. In a reception block 952, a notification is received of breakthrough at one or more of the defined virtual sensors for a future time (e.g., received via a software module, communication link, etc.). In response to the notification, an adjustment block 956 adjusts one or more injection site parameters for the model (e.g., the defined model 930) in an attempt to alter the breakthrough behavior. A performance block 960 performs a simulation based on the adjustment(s). A decision block 964 decides, based on the simulation results, whether breakthrough still occurs at the future time. If so, the method 940 continues at the adjustment block 956 to further adjust one or more injection site parameters for the model; otherwise, the method 940 continues at an adjustment block 968 where actual injection site adjustments are made (e.g., in the field according to the one or more adjusted model parameters). Such a method can help manage material recovery from a reservoir, for example, by proactively uncovering breakthrough behavior at future times.

Figure 10:
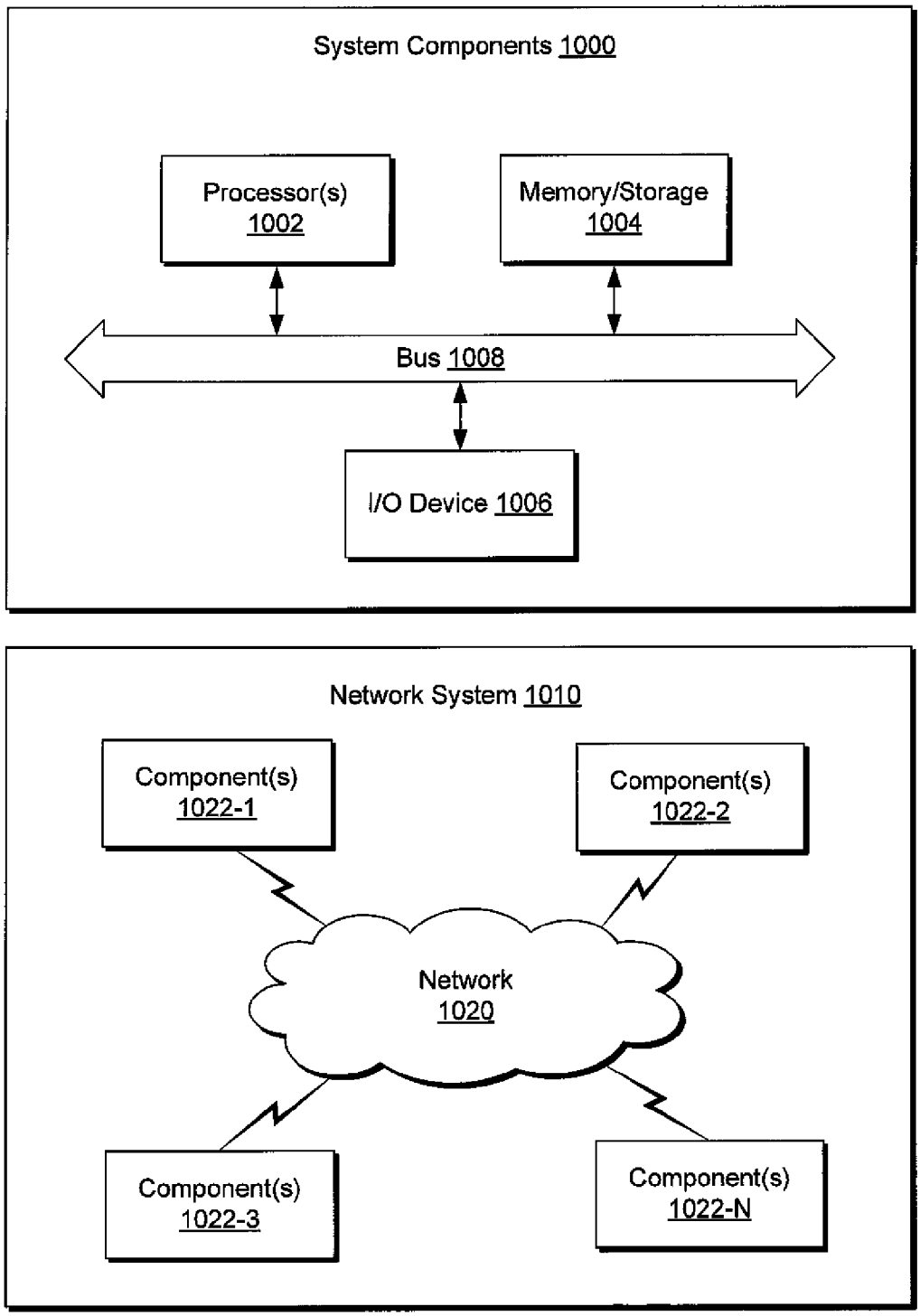
FIG. 10 illustrates example components of a system and a networked system.

FIG. 10 shows components of a computing system 1000 and a networked system 1010. The system 1000 includes one or more processors 1002, memory and/or storage components 1004, one or more input and/or output devices 1006 and a bus 1008. As described herein, instructions may be stored in one or more computer-readable media (e.g., memory/storage components 1004). Such instructions may be read by one or more processors (e.g., the processor(s) 1002) via a communication bus (e.g., the bus 1008), which may be wired or wireless. The one or more processors may execute such instructions to implement (wholly or in part) one or more virtual sensors (e.g., as part of a method). A user may view output from and interact with a process via an I/O device (e.g., the device 1006).

As described herein, components may be distributed, such as in the network system 1010. The network system 1010 includes components 1022-1, 1022-2, 1022-3, . . . 1022-N. For example, the components 1022-1 may include the processor(s) 1002 while the component(s) 1022-3 may include memory accessible by the processor(s) 1002. Further, the component(s) 1002-2 may include an I/O device for display and optionally interaction with a method. The network may be or include the Internet, an intranet, a cellular network, a satellite network, etc.

CONCLUSION

Although various methods, devices, systems, etc., have been described in language specific to structural features and/or methodological acts, it is to be understood that the subject matter defined in the appended claims is not necessarily limited to the specific features or acts described. Rather, the specific features and acts are disclosed as examples of forms of implementing the claimed methods, devices, systems, etc.

The invention claimed is:

1. One or more computer-readable storage media comprising computer-executable instructions to instruct a computing system to:

receive simulation results for a simulation of future behavior of a reservoir that includes a material production well and a fluid injection site, the simulation results being from a history matched reservoir simulator that implements a numerical technique that discretizes the reservoir into blocks and parameters for the blocks wherein the numerical technique models the reservoir, the material production well and the fluid injection site;

define a model sensor as a line, a surface or a volume with respect to one or more of the blocks and associated parameters, the modeled sensor located a distance from the modeled material production well and between the modeled material production well and the modeled fluid injection site;

determine fluid saturation at the modeled sensor based at least in part on the simulation results for the associated parameters of the modeled sensor;

perform a surveillance workflow analysis for the reservoir based at least in part on the determined fluid saturation and field data for the reservoir; and issue a notification if the fluid saturation at the modeled sensor exceeds a fluid saturation limit.

2. The one or more computer-readable storage media of claim 1 further comprising computer-executable instructions to instruct a computing system to determine pressure at the modeled sensor based at least in part on the simulation results for the associated parameters of the modeled sensor.

3. The one or more computer-readable storage media of claim 2 further comprising computer-executable instructions to instruct a computing system to issue a notification if the pressure at the modeled sensor exceeds a pressure limit.

4. The one or more computer-readable storage media of claim 1 wherein the fluid saturation comprises gas saturation.

5. The one or more computer-readable storage media of claim 4 further comprising computer-executable instructions to instruct a computing system to issue a notification if the gas saturation at the modeled sensor exceeds a gas saturation limit.

6. The one or more computer-readable storage media of claim 1 further comprising computer-executable instructions to instruct a computing system to determine gas saturation and liquid saturation at the modeled sensor based at least in part on the simulation results for the associated parameters of the modeled sensor.

7. The one or more computer-readable storage media of claim 1 wherein the future behavior corresponds to a future time and further comprising computer-executable instructions to instruct a computing system to issue a notification prior to the future time.

8. The one or more computer-readable storage media of claim 1 further comprising computer-executable instructions to instruct a computing system to determine an adjustment to one or more parameters associated with recovery of material from the reservoir by the material production well.

9. The one or more computer-readable storage media of claim 1 wherein the simulation results for future behavior of a reservoir comprise results for a reservoir that includes multiple fluid injection sites.

10. The one or more computer-readable storage media of claim 1 further comprising computer-executable instructions to instruct a computing system to redefine the line, the surface or the volume that models the modeled sensor to relocate the modeled sensor, based at least in part on the determined fluid saturation, closer to the modeled material production well or closer to the modeled fluid injection site.

11. The one or more computer-readable storage media of claim 1 wherein the simulation results for future behavior of a reservoir comprise results for a reservoir that includes an oil production well and a water injection site.

12. A method comprising:

providing a history matched reservoir simulator that implements a numerical technique that discretizes a reservoir into blocks and parameters for the blocks wherein the numerical technique models the reservoir, a material production well and a fluid injection site;

for the modeled reservoir, defining a model sensor as a line, a surface or a volume with respect to one or more of the blocks and associated parameters, the modeled sensor located a distance from the modeled material production well and between the modeled material production well and the modeled fluid injection site;

performing, with the reservoir simulator, a simulation of the reservoir for a future time where an analysis of results from the simulation for the associated parameters of the modeled sensor indicates that specified fluid reaches the modeled sensor at the future time; and based at least in part on the results, and prior to the future time, adjusting one or more parameters associated with recovery of material from the reservoir by the material production well.

13. The method of claim 12 wherein the specified fluid comprises at least one member selected from a group consisting of gas and liquid.

14. The method of claim 12 wherein the performing performs the simulation based in part on a liquid phase, a gas phase and a gas-liquid phase.

15. One or more computer-readable storage media comprising computer-executable instructions to instruct a computing system to:

receive simulation results for a simulation of future behavior of a reservoir that includes a material production well and a fluid injection site, the simulation results being from a history matched reservoir simulator that implements a numerical technique that discretizes the reservoir into blocks and parameters for the blocks wherein the numerical technique models the reservoir, the material production well and the fluid injection site;

define a model sensor as a line, a surface or a volume with respect to one or more of the blocks and associated parameters, the modeled sensor located a distance from the modeled material production well and between the modeled material production well and the modeled fluid injection site;

determine one or more variables at the modeled sensor based at least in part on the simulation results for the associated parameters of the modeled sensor; and redefine the line, the surface or the volume that models the modeled sensor to relocate the modeled sensor, based at least in part on the one or more variables, closer to the modeled material production well or closer to the modeled fluid injection site.

16. The one or more computer-readable storage media of claim 15 further comprising computer-executable instructions to instruct a computing system to define another model sensor as a line, a surface or a volume with respect to one or more of the blocks and associated parameters, the second modeled sensor located between the modeled material production well and the modeled fluid injection site.

17. The one or more computer-readable storage media of claim 16 further comprising computer-executable instructions to instruct a computing system to determine one or more variables at the second modeled sensor based at least in part on the simulation results for the associated parameters of the second modeled sensor.

18. The one or more computer-readable storage media of claim 15 wherein the one or more variables comprise at least one member selected from a group consisting of fluid front direction, fluid front speed, water saturation, gas saturation and pressure.

19. The one or more computer-readable storage media of claim 15 further comprising computer-executable instructions to instruct a computing system to determine a time for a fluid front to arrive at the modeled material production well.

* * * * *